US005309612A

United States Patent [19]

Briere et al.

[11] Patent Number: 5,309,612

[45] Date of Patent: May 10, 1994

[54] FASTENING DEVICE FOR FOAM UPHOLSTERING

[75] Inventors: Jean Briere, Fontaine; Erminio Moretti, Grenoble, both of France

[73] Assignee: A. Raymond & Cie, Grenoble, France

[21] Appl. No.: 903,971

[22] Filed: Jun. 26, 1992

[30] Foreign Application Priority Data

Jun. 29, 1991 [DE] Fed. Rep. of Germany ..... 4121574

[51] Int. Cl.[5] ..... A44B 1/00; A47C 31/00

[52] U.S. Cl. ..... 24/90 B; 24/90.5; 24/102 T; 5/472

[58] Field of Search ..... 24/90 B, 90 A, 90.5, 24/93, 94, 102 T, 102 E, 453; 5/472

[56] References Cited

U.S. PATENT DOCUMENTS

| | | | |
|---|---|---|---|
| 527,555 | 10/1894 | Holmes | 24/90.5 |
| 2,190,469 | 2/1940 | Bux | 5/472 |
| 3,608,157 | 9/1971 | Molt | 24/102 T |
| 3,725,980 | 4/1973 | Burgio | 24/90 A |
| 4,570,306 | 2/1986 | Eyler | 24/90 B |

FOREIGN PATENT DOCUMENTS

| | | | |
|---|---|---|---|
| 0008986 | 3/1980 | European Pat. Off. | 5/472 |
| 0525170 | 5/1931 | Fed. Rep. of Germany | 24/90 B |
| 0419016 | 12/1910 | France | 24/94 |

*Primary Examiner*—Victor N. Sakran
*Attorney, Agent, or Firm*—Finnegan, Henderson, Farabow, Garrett & Dunner

[57] ABSTRACT

A fastening device for detachably fitting protective covers on upholstered foam material, such as seat cushions, seat backs or mattresses, by means of upholstery buttons which can be attached to the fastening device in the manner of snap fasteners. The fastening device consists of a connecting tape (1) on both ends of which are molded attached end pieces (2, 3) which have spherical heads (4) and (5) onto which the upholstery buttons can be pressed. One attached end piece (2) has on the side facing the tape a cylindrical stem (12) and on the stem, at a short distance from the head, is a stop plate (6) for holding the attached end piece (2) against one side of the foam. The other attached end piece has on its side facing the tape, a stem (12) on which is located, at a short distance from its head (5), a smaller support plate (7) whose diameter corresponds approximately to the diameter of the spherical head (5). This plate serves as support for an anchor plate (8) that bears against the other side of the foam after the end piece (3) has been pulled through the foam object.

2 Claims, 2 Drawing Sheets

FASTENING DEVICE FOR FOAM UPHOLSTERING

BACKGROUND OF THE INVENTION

Most known upholstery systems for foam upholstering consist of a simple button which, for mounting purposes, is provided on its inner side with a hook joined to a tape or string or a small chain.

The tape is pushed or pulled through the compressed foam material of the cushion with the aid of a tool (a kind of special needle) and a second button or other retaining means is then fastened on the free or outermost end of tape.

When the user wishes to remove the protective cover of the cushion for cleaning, the upholstery buttons must be detached. Usually this means the tape must be cut or otherwise severed. However, in order to be able to put the upholstery buttons back in place after the protective cover has been refitted, not only is a suitable tool required to reinstall the buttons, but the user must also be a skilled craftsman.

An object of the present invention therefore is to design a fastening device which enables the cushion to be fitted for receipt of the upholstery buttons before the protective cover is pulled on, so that the protective cover can at any time easily be unbuttoned and removed and buttoned on again.

SUMMARY OF THE INVENTION

This object is achieved in accordance with the present invention, by providing a fastening device for detachably fastening upholstery buttons to upholstering objects comprising a flexible length of tape adapted to be pulled through the object, said tape having a length approximating the thickness of the object, two end pieces, each end piece having an outer spherical head portion integrally connected at its base to a narrower inner cylindrical stem portion that is attached to one end of said tape, a first one of said end pieces having an integrally connected stop plate located between the base of its head portion and stem portion and extending radially out beyond said portions for holding said first end piece against one side of said upholstering object, the second one of said end pieces having a support plate located between the base of its head portion and stem portion and having a diameter corresponding approximately to the diameter of the spherical head so that said second end piece can be pulled through said object, and a retaining part adapted to bear against the side of the support plate opposite from spherical head of said second end piece after said second end piece has been pulled through the object to hold said second end piece against the opposite side of the upholstering object, said spherical heads of said end pieces being shaped to receive and hold upholstering buttons having resilient fastening means adapted to snap fit over said heads.

The cushion covers are in turn provided with opening through which the spherical heads of the end pieces of the tape can pass. When the cover has been fitted on, all that remains to be done is to press one or more of plain or covered buttons onto the spherical heads of the fastening device.

In order to clean the protective covers, the user simply has to detach the buttons and pull off the cover, while the tape and the attached pieces remain in position in the foam rubber of the cushion.

BRIEF DESCRIPTION OF THE DRAWINGS

Two exemplary embodiments of the fastening device of the invention, which will be explained more fully below, are illustrated in drawings, in which.

DETAILED DESCRIPTION OF THE INVENTION

Figure 7:
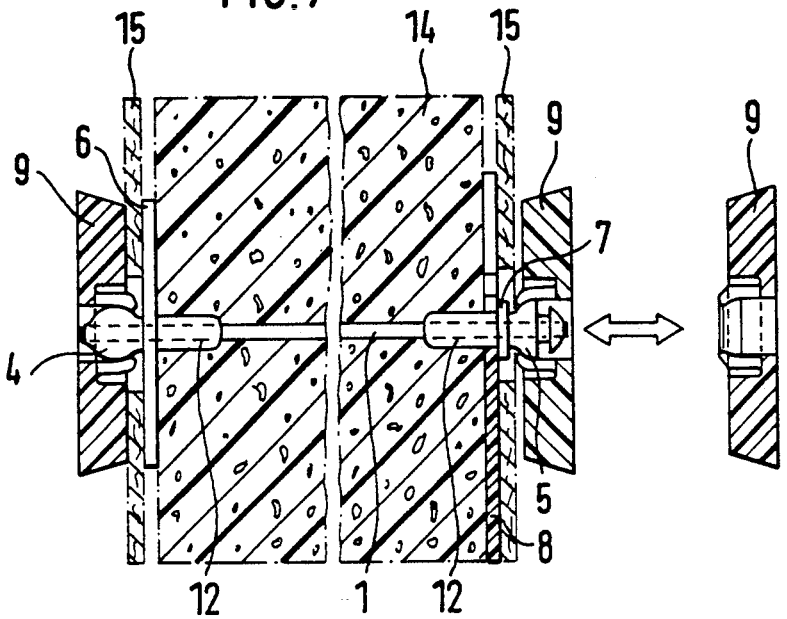
FIG. 7 shows the fastening device mounted in foam upholstering with a protective cover.

The fastening device shown in the drawings serves for detachably fitting protective covers 15 on upholstered foam objects 14, such as, for example, seat cushions, seat backs, or mattresses (FIG. 7).

The fastening device consists of a flexible connecting tape 1 and attached end pieces 2 and 3, which are integrally molded on its two ends or bonded thereto by molding on or over said ends or in any other known way.

Figure 1:
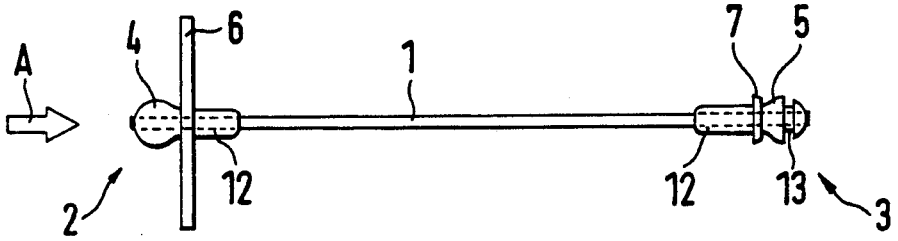
FIG. 1 is a front view of the connecting tape of a fastening attached end pieces.
Figure 2:
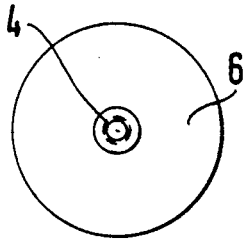
FIG. 2 is a plan view of the left-hand attached end piece, vie the direction of arrow "A"

The attached end piece 2 shown on the left side in FIG. 1 consists of an outer spherical head portion 4, the base of which is connected to an inner cylindrical stem portion 12. It is provided, immediately next to spherical head 4 on the side facing the stem 12, with a, preferably, circular stop plate 6, which forms a stop surface for the attached end piece 2 when the connecting tape 1 is pulled through the foam object 14 to the right.

The other attached end piece 3, shown on the right side in FIG. 1, likewise consists of a spherical head portion 5, to which a cylindrical stem portion 12 is attached at its base, and is provided, immediately next to the base of the spherical head 5, with a smaller, circular support plate 7 whose diameter corresponds approximately to that of spherical head 5. This plate 7 is intended to form a support for a retaining part, described more fully below, which part is supported on the rear face of plate 7 after the connecting tape 1 has been pulled through the foam object 14.

Figure 9:
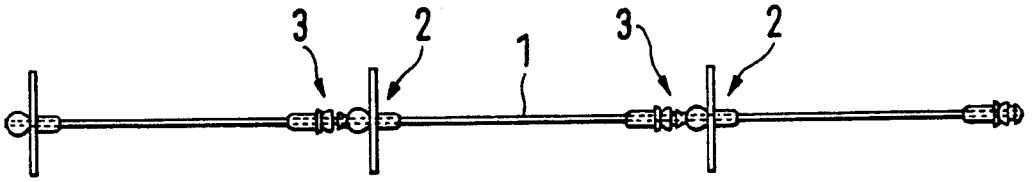
FIG. 9 shows a number of fastening devices formed by injection molding in a continuous row.

Attached end pieces 2 and 3 are expediently molded at predetermined distances on a continuously molded plastic filament or tape 1, the distance between the attached pieces 2 and 3 being variable by changing the roll-off speed (see FIG. 9).

By cutting the connecting tape 1 between each two attached pieces 2 and 3 molded on it in succession, fastening devices ready for the upholstering of the foam material, can then be obtained from a tape supplied in a continuous length.

Figure 3:
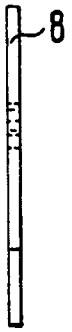
FIG. 3 is a front view of a loose anchor plate.
Figure 4:
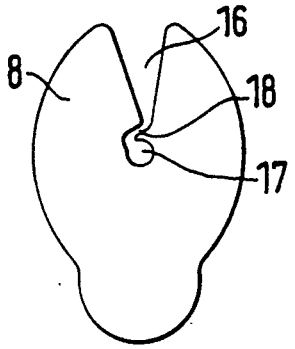
FIG. 4 is a plan view of the anchor plate.

For retaining attached end piece 3 after connecting tape 1 shown in FIG. 1 has been pulled through the foam 14, an anchor plate 8, as shown in FIGS. 3 and 4, as the retaining part can be provided. Plate 8 has at its center a hole 17 corresponding to the outside diameter of stem 12, which hole is connected to an opening 16 widening in a funnel shape toward the edge of the plate.

Shortly before reaching the hole 17, opening 16 has a constriction 18, so that the anchor plate 8 is held firmly in place on stem 12 after it has been pressed onto it.

Figure 5:
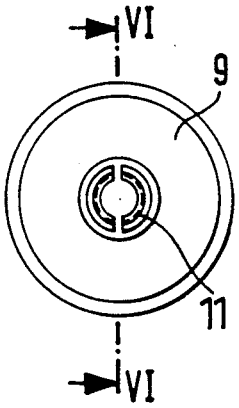
FIG. 5 is a plan view of a suitable upholstery button.
Figure 6:
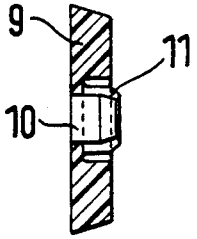
FIG. 6. is a sectional view of the upholstery button taken along line VI—VI in FIG. 5.

FIGS. 5 and 6 show a suitable upholstery button 9 of plastic material, which can be engaged with the spherical heads 4 and 5 in the manner of a snap fastener. The upholstery button 9 for this purpose is provided at its center with a recess 10 surrounded on the snap-on side by two catch half-rings 11. The latter correspond in their inside diameter to the outside diameter of spherical heads 4 and 5 and are bent over slightly towards the center in the region of their front edges. This edge region opens slightly out elastically when the upholstery button 9 is pressed onto the spherical heads 4 or 5 and then springs back behind the spherical surface into its original position, the catch half-rings 11 thus being clamped against the sides of the spherical heads 4 or 5 that face the stop plates 6 or 7, respectively.

For upholstering a foam object 14, the object is first compressed and perforated with the aid of a needle. A pointed gripping tool is then inserted at this point and the spherical head 5 is gripped by the tool at a groove 13 specially provided for this purpose and is then pulled through the foam until the stop plate 6 lies against one face of it. Then on the other side of the foam object 14, attached end piece 3 is secured in place by anchor plate 8, which is pressed from the side onto the stem 12, adjacent the rear face of support plate 7, until the stem 12 passes through constriction 18 and is engaged in the hole 17 in the plate 8.

A protective cover 15 is then pulled over the foam object in such a manner that fastening holes in it coincide with the spherical heads 4 and 5. All that then remains to be done is to push buttons 9 onto the spherical heads 4 and 5, the buttons usually being covered for decorative purposes with the material used for the protective cover. It is obviously also possible, depending on circumstances, for these upholstery buttons 9 to be clipped on or otherwise fastened in a known manner at predetermined points in the protective cover 15.

Figure 8:
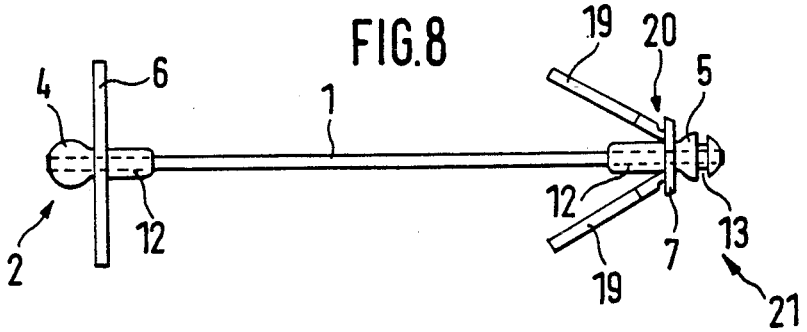
FIG. 8 shows an alternative form of construction of the fastening device.

FIG. 8 shows another exemplary embodiment of the fastening device, in which attached end piece 2 on the left-hand side is the same as that shown in FIG. 1. On the other hand, the attached end piece 21 on the right-hand side differs from the piece 3 in FIG. 1 in that instead of separate anchor plate 8, at least two anchor wings 19 projecting obliquely toward the rear and integrally connected to plate 7 with film hinges 20, are pivotably formed on the end piece. When the attached end piece 21 is pulled through the previously perforated foam object 14, these wings 19 will lie back against stem 12 and, after passing through the foam, will then open out and lie against the rear side of plate 7 and against the side of the foam material 14 to hold the device in place.

The foam object 14 is then ready to be fitted with the protective cover 15. Fastening by means of the upholstery buttons 9 is effected in the same manner as previously described.

We claim:

1. A fastening device for detachably fastening upholstery buttons to upholstering objects comprising a flexible length of tape adapted to be pulled through the object, said tape having a length approximating the thickness of the object, two end pieces, each end piece having an outer spherical head portion integrally connected at its base to a narrower inner cylindrical stem portion that is attached to an end of said tape, a first one of said end pieces having an integrally connected stop plate located between the base of its head portion and stem portion and extending radially out beyond said portions for holding said first end piece against one side of said upholstering object, the second one of said end pieces having a support plate located between the base of tis head portion and stem portion and having a diameter corresponding approximately to the diameter of the spherical head so that said second end piece can be pulled through said object, and a separate anchor plate adapted to bear against the side of the support plate opposite from said spherical head of said second end piece after said second end piece has been pulled through the object to hold said second end piece against the opposite since of the upholstering object, said anchor plate having a central retaining hole having a diameter corresponding approximately to the diameter of the cylindrical stem portion of said second end piece, a funnel shaped opening extending from a side of said anchor plate toward said central hole and a constricted passage having a diameter less than the cylindrical stem portion connected between said central hole and said funnel opening through which the cylindrical stem portion of the second end piece can pass by elastically widening the constricted passage as the funnel opening in the anchor plate is inserted onto said stem portion from the side adjacent said support plate to thereby firmly hold the anchor plate in place on the stem of said second end piece, said spherical heads of said end pieces being shaped to receive and hold upholstering buttons having resilient fastening means adapted to snap fit over said heads.

2. A fastening device for detachably fastening upholstery buttons to upholstering objects comprising a flexible length of tape adapted to be pulled through the object, said tape having a length approximating the thickness of the object, two end pieces, each end piece having an outer spherical head portion integrally connected at its base to a narrower inner cylindrical stem portion that is attached to an end of said tape, a first one of said end pieces having an integrally connected stop plate located between the base of its head portion and stem portion and extending radially out beyond said portions for holding said first end piece against one side of said upholstering object, the second one of said end pieces having a support plate located between the base of its head portion and stem portion and having a diameter corresponding approximately to the diameter of the spherical head so that said second end piece can be pulled through said object, and a plurality of wing elements hingedly connected to the side of the support plate opposite from said spherical head of said second end piece, said wing elements lying flat against said stem portion of the second end piece as it is being pulled through the object and then being pivotable out perpendicular thereto after said second end piece has been pulled through the object to hold said second end piece against the opposite side of the upholstering object, said spherical heads of said end pieces being shaped to receive and hold upholstering buttons having resilient fastening means adapted to snap fit over said heads.

* * * * *

UNITED STATES PATENT AND TRADEMARK OFFICE

CERTIFICATE OF CORRECTION

PATENT NO. : 5,309,612

DATED : May 10, 1994

INVENTOR(S) : Jean Briere et al.

It is certified that error appears in the above-identified patent and that said Letters Patent is hereby corrected as shown below:

Claim 1, column 4, line 9, change "tis" to --its--;

column 4, line 17, change "since" to --side--.

Signed and Sealed this

Fifteenth Day of November, 1994

Bruce Lehman

*Attest:*

BRUCE LEHMAN

*Attesting Officer*

*Commissioner of Patents and Trademarks*